United States Patent [19]

Baier

[11] 4,179,067

[45] Dec. 18, 1979

[54] RAILWAY TRACK HOLD-DOWN HARDWARE

[76] Inventor: Ludwig S. Baier, 9998 French Prairie Dr., Wilsonville, Oreg. 97070

[21] Appl. No.: 874,257

[22] Filed: Feb. 1, 1978

Related U.S. Application Data

[63] Continuation-in-part of Ser. No. 716,269, Aug. 20, 1976, abandoned, and Ser. No. 774,741, Mar. 7, 1977, abandoned.

[51] Int. Cl.[2] ..... E01B 3/34; E01B 9/28; E01B 9/30; E01B 9/62

[52] U.S. Cl. ..... 238/91; 151/7; 238/94; 238/283; 238/338; 238/349; 238/377

[58] Field of Search ..... 238/91, 92, 94, 283, 238/310, 349, 350, 372, 373, 377, 83, 84, 85, 115, 29, 265, 315, 338; 151/7; 106/14.34

[56] References Cited

U.S. PATENT DOCUMENTS

| | | | |
|---|---|---|---|
| 1,784,901 | 12/1930 | Klingensmith | 238/92 |
| 2,110,894 | 3/1938 | Stedman | 238/283 X |
| 2,858,988 | 11/1958 | Luther | 238/283 |
| 3,308,865 | 3/1967 | Raichelson et al. | 151/7 |
| 3,335,955 | 8/1967 | Palfreyman | 238/283 |
| 3,519,205 | 7/1970 | Monclin et al. | 238/310 X |
| 3,558,060 | 1/1971 | Crespo | 238/349 |
| 3,685,783 | 8/1972 | Hilson | 238/377 X |
| 3,770,513 | 11/1973 | Wystrach | 106/14.34 X |
| 3,831,842 | 8/1974 | Tamura | 238/283 X |

FOREIGN PATENT DOCUMENTS

| | | | |
|---|---|---|---|
| 477163 | 9/1915 | France | 238/349 |
| 905796 | 12/1945 | France | 238/349 |
| 1060470 | 4/1954 | France | 238/349 |
| 288933 | 2/1953 | Switzerland | 238/349 |
| 869666 | 6/1961 | United Kingdom | 238/349 |
| 869833 | 6/1971 | United Kingdom | 238/349 |

*Primary Examiner*—Randolph A. Reese
*Attorney, Agent, or Firm*—Lee R. Schermerhorn

[57] ABSTRACT

A base member, such as a cross tie, is molded of reinforced concrete or wood chips and resin. Depressions in the top of the base member are lined with pads of cushion material to seat the flanges of the rails. A pair of hold-down clips is seated on each pad on opposite sides of each rail. Bolts in the clips are secured by tubular nuts having deformed lower ends shaped to anchor the nuts in the molded base member.

6 Claims, 12 Drawing Figures

FIG. 5
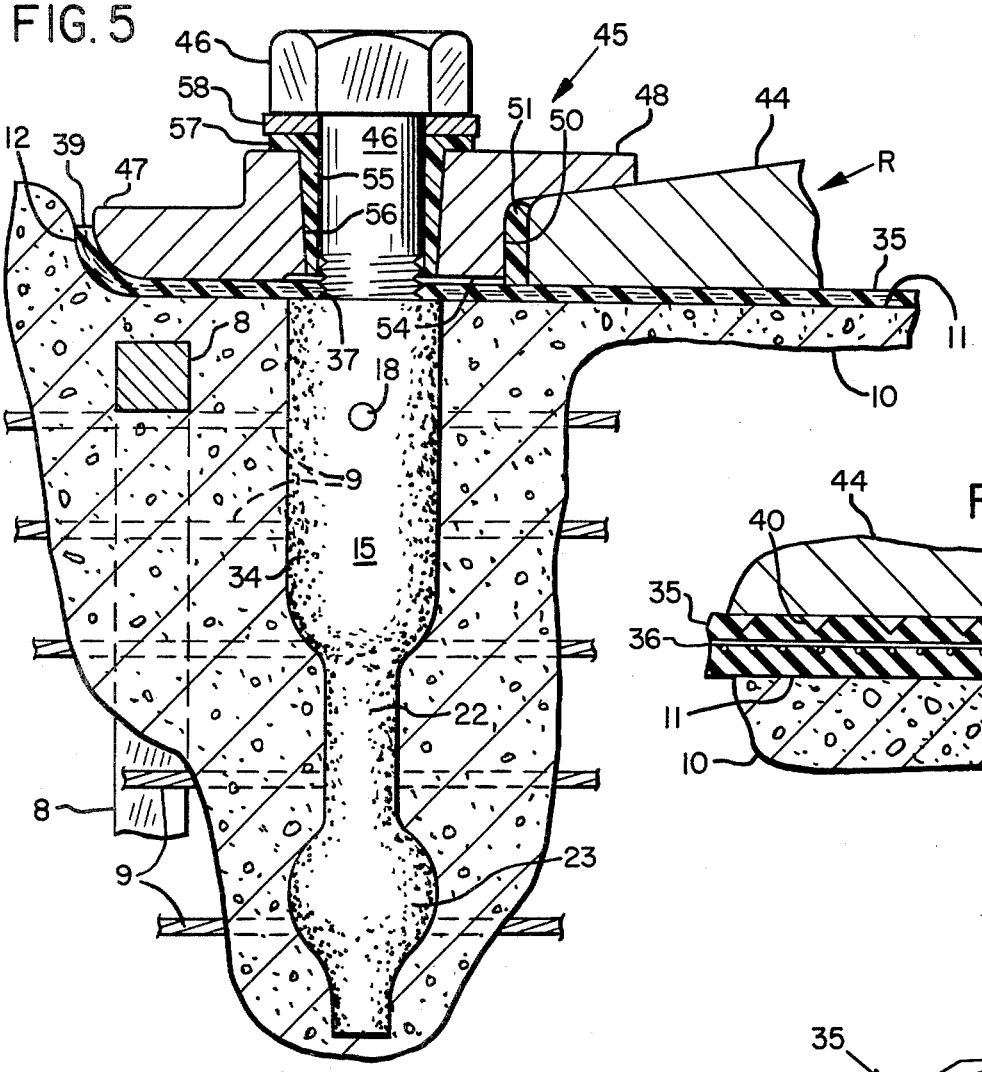
FIG. 6
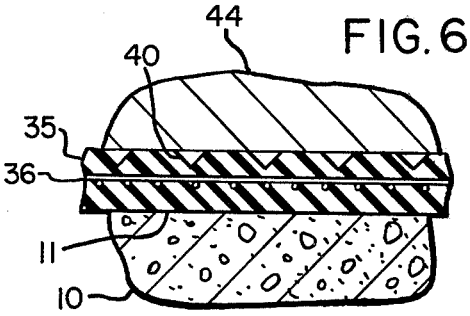
FIG. 7
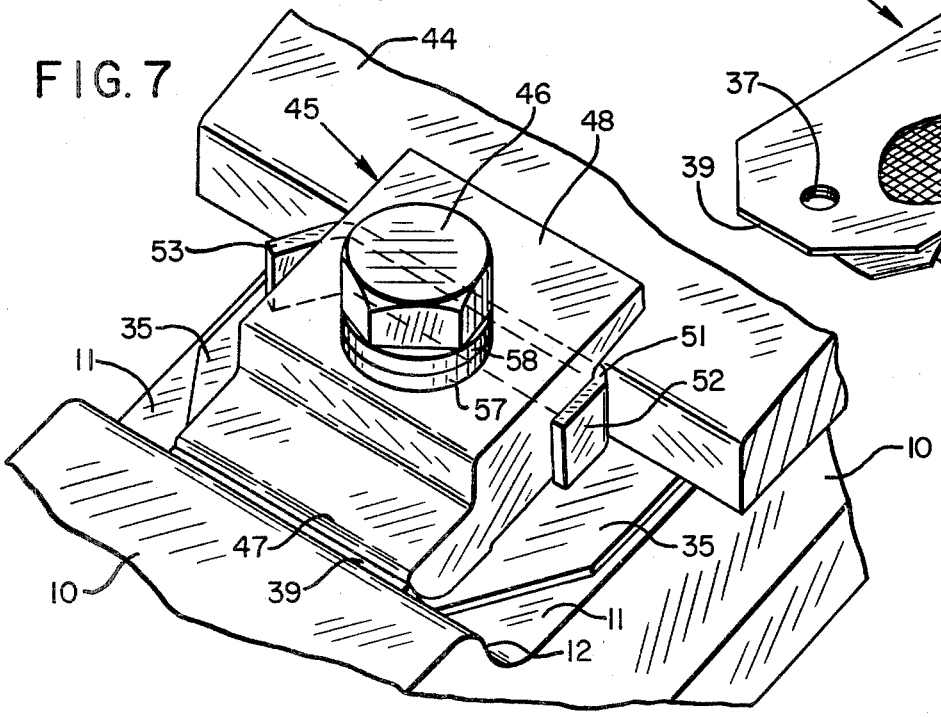
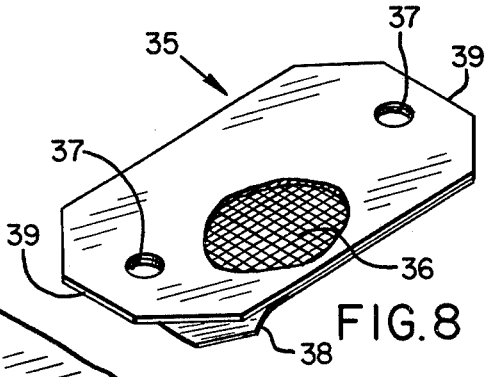
FIG. 8

RAILWAY TRACK HOLD-DOWN HARDWARE

CROSS-REFERENCES TO RELATED APPLICATIONS

This application is a continuation-in-part of my application Ser. No. 716,269 filed Aug. 20, 1976 and my application Ser. No. 774,741 filed Mar. 7, 1977 both abandoned.

BACKGROUND OF THE INVENTION

This invention relates to railway track hold-down hardware.

Much attention has been given to improvements in rolling stock for the high speed transportation of passengers and freight by rail but too little attention has been given to improvements in the track. It is a common experience to find that the speed and safety of rail transportation are limited not by the locomotives and cars but by the track itself. Most previous attempts to improve the track have been unsuccessful because of complicated and expensive hardware which has been economically impractical.

Objects of the present invention are, therefore, to provide improved railway track hold-down hardware, to provide track equipment which is simple and economical to manufacture and install and to provide track equipment which has a long life in hard service and requires a minimum of maintenance work to keep it in efficient operating condition.

SUMMARY OF THE INVENTION

The present track hardware is utilized in connection with a molded base member. The base member may be made of reinforced, pre-strssed concrete in the form of a cross tie or in the form of an elongated slab which takes the place of several ties. Also, the base member may be of composite construction comprising a tie molded from wood chips and resin.

Depressions in the top of the base member are lined with strips of cushion material, or pads, to seat the flanges of the rails. A pair of hold-down clips is seated on each pad on opposite sides of each rail. The clip may be a solid block of metal or it may be formed as a bent strip of metal. Bolts in the clips are secured by tubular nuts provided with suitable retention means to anchor them in the molded base member.

The invention will be better understood and additional objects and advantages will become apparent from the following detailed description of the preferred embodiments illustrated in the accompanying drawings. Various changes may be made however, in the details of construction and arrangement of parts and certain features may be used without others. All such modifications within the scope of the appended claims are included in the invention.

BRIEF DESCRIPTION OF THE DRAWINGS

FIG. 5 is a fragmentary cross-sectional view thru one flange of a rail secured to a molded base member by the present hold-down hardware and showing a rolled form of clip.

FIG. 6 is an enlarged view of a portion of FIG. 5.

FIG. 7 is a fragmentary perspective view of the parts shown in FIG. 5.

FIG. 8 is a perspective view with parts broken away showing the cushion pad in FIGS. 5, 6 and 7.

DESCRIPTION OF THE PREFERRED EMBODIMENTS

Figure 1:
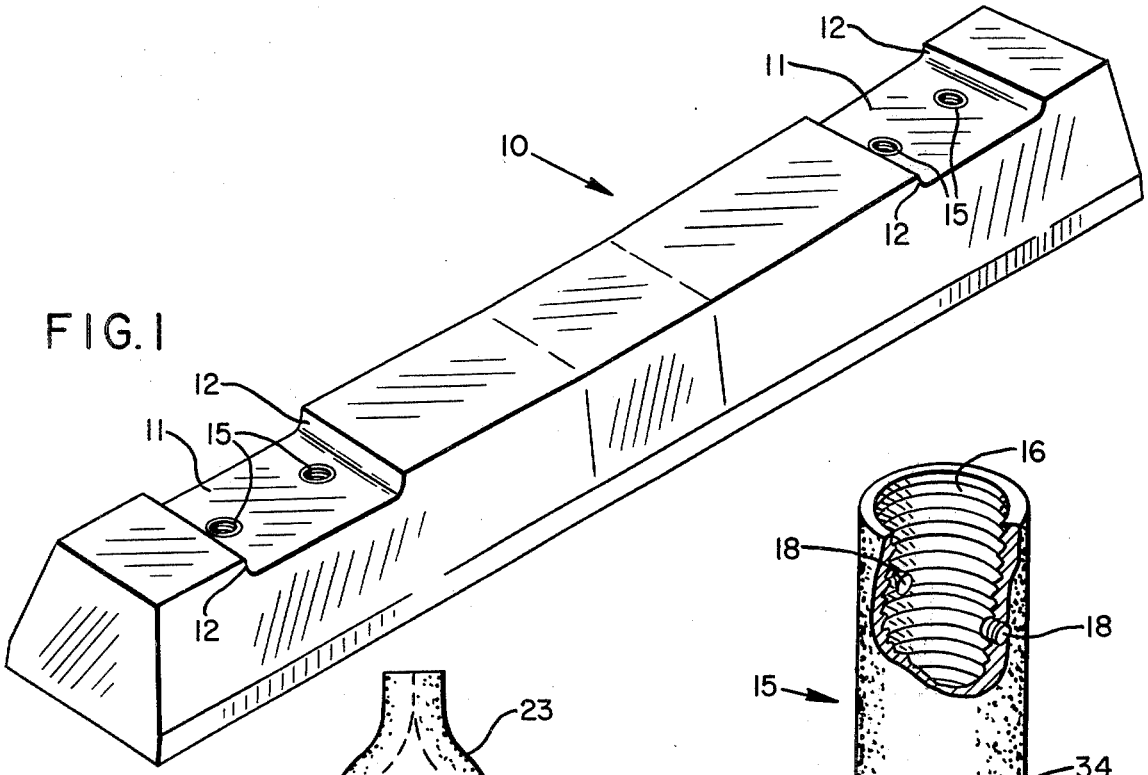
FIG. 1 is a perspective view of a molded base member in the form of a cross-tie embodying the invention.

In FIG. 1 the base member 10 is in the form of a crosstie molded from reinforced and prestressed concrete although as previously stated it may alternatively be molded of a composite material comprising wood chips and resin.

The tie is characterized by a pair of transverse depressions 11 to receive the flanges of the track rails, the depressions being wider than the rail flanges. The opposite sides of each depression are bounded by a pair upstanding side walls 12. Visible in each depression 11 are the upper ends of a pair of tubular nuts 15 which are embedded in the tie.

Figure 2:
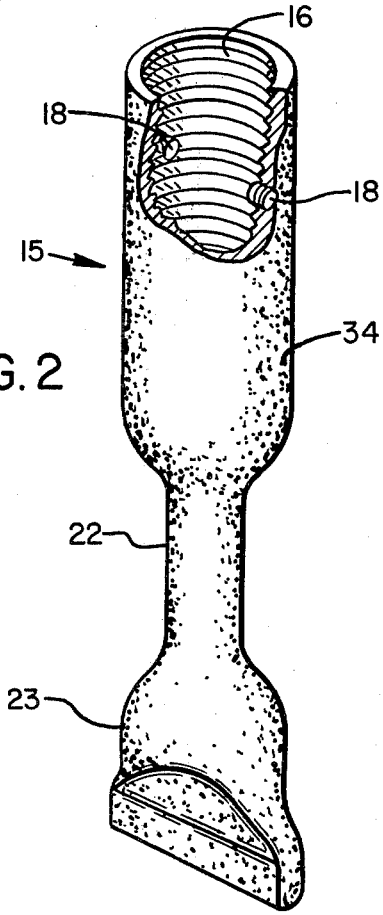
FIG. 2 is a perspective view with parts broken away showing the construction of the tubular nuts embedded in the base member in FIG. 1.

The construction of nut 15 is shown in FIG. 2. The inside of the nut is threaded at 16 to receive a bolt. A pair of aligned radial holes 17 contains plugs 18 of hard plastic such as nylon to lock the bolt in the nut. The inner ends of plugs 18 protrude into the grooves of threads 16 and are deformed by the threads of the bolt to exert a powerful frictional engagement with the bolt and prevent loosening of the bolt under vibration. The outer ends of plugs 18 are flush with the outer surface of the tubular nut whereby the plugs are engaged by the molded material of the tie surrounding the nut.

Figure 4:
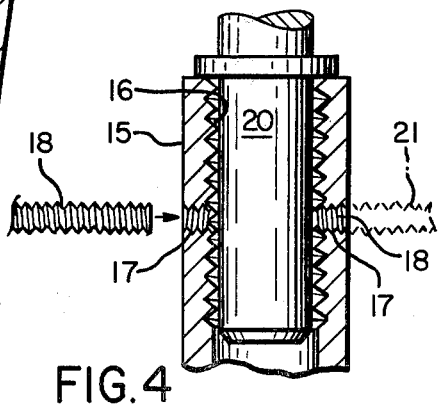
FIG. 4 is a fragmentary sectional view showing how plastic plugs are installed in the tubular nuts in positions to grip and lock anchor bolts when the bolts are subsequently screwed into the nuts.

Plugs 18 are threaded to screw into the holes 17 which are threaded to receive them. The plugs are screwed in to engage a smooth cylindrical mandrel 20 which is inserted into nut 15 to locate the inner ends of the plugs at approximately the peak of the thread profile of threads 16. Plugs 18 have excess length at 21 in FIG. 4 which is cut off flush with the outer surface of nut 15.

Each nut 15 is anchored securely in the tie by a swaged lower end having a reduced cylindrical neck 22 and a flattened extremity at 23 which is wider than the neck portion. Such a nut may be formed economically from a short length of tubing.

Figure 3:
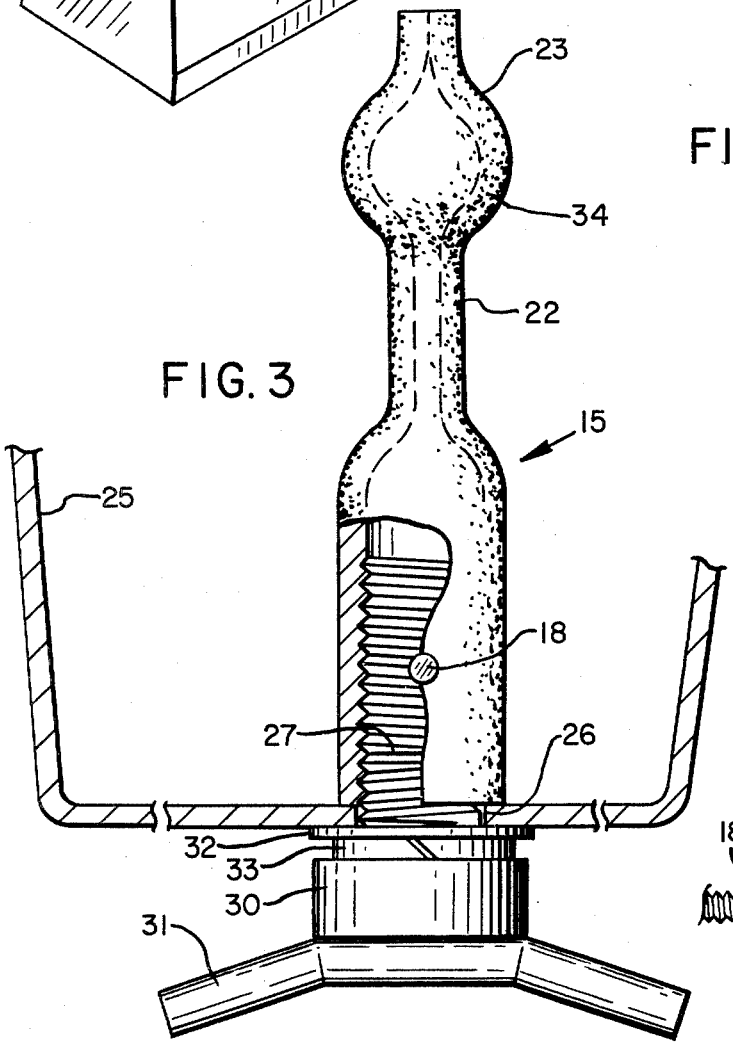
FIG. 3 is a cross-sectional view of a mold with parts broken away showing an anchoring tool for centering the tubular nuts in a mold for a tie.

FIG. 3 illustrates an anchoring tool for centering each nut 15 in proper position in a mold 25 for the tie 10. The bottom of mold 25 contains a smooth hole 26 to receive the threaded end 27 of tool 30. Threaded end 27 is of insufficient length to engage the locking plugs 18. Tool 30 is essentially merely a short bolt having crossbar 31 welded on its head for convenient manipulation. Above the head of the bolt are positioned a flat washer 32 and a spring lock washer 33. Thus, the nuts 15 are accurately positioned in the depressions 11 of the tie 10 when the latter is formed in the mold 25. After the molding operation the tools 30 are removed to free the tie from the mold.

As a further means of insuring that tubular nut 15 will bond to the molded material of the tie 10 it is preferred to apply a coat of epoxy liquid resin to the exterior surface of nut 15. When the resin dries to a tacky state dry sand is applied to adhere to the resin as the resin hardens. The sanded surface provides a better bond to the wet concrete or other material of which the tie is molded and the epoxy also acts as a rust preventative to prevent corrosion of nut 15. Such a sanded surface is indicated at 34 in FIG. 5.

Figure 9:
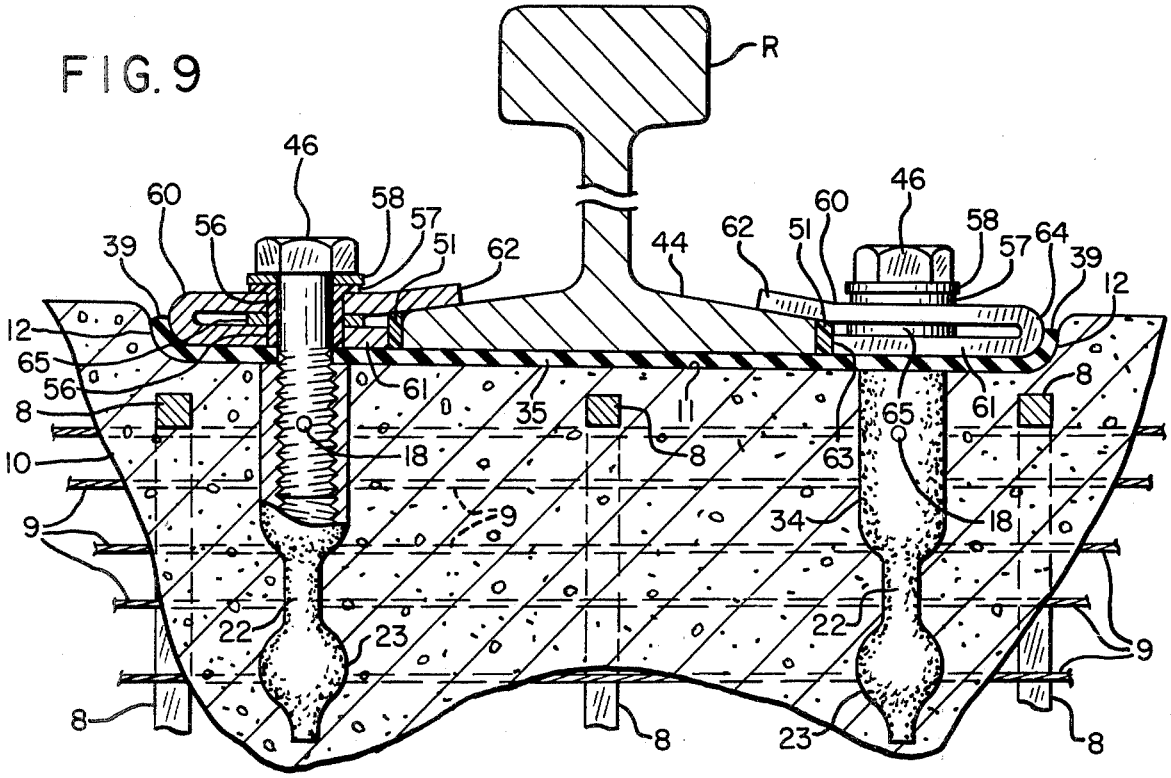
FIG. 9 is a cross-sectional view thru a rail and base member showing an alternative form of clip.

The tie may be strengthened around each nut 15 by reinforcing steel 8, if desired. As shown in FIGS. 5 and 9, reinforcing steel 8 comprises a one half inch square steel bar bent to approximately rectangular configuration, with upper and lower horizontal portions and two upright portions, surrounding the tensioned longitudinal prestressing steel cables 9 in the tie. There are three reinforcing members 8 at each rail position as best shown in FIG. 9.

A cushion pad 35 is adhered in each depression 11 as shown in FIGS. 5 and 7. Pad 35 is made of suitable plastic such as neoprene reinforced with nylon fabric 36 as shown in FIGS. 6 and 8. The pad is punched with holes at 37 to register with the bolt holes in nuts 15 in FIG. 1. Holes 37, however, are made slightly smaller than the threaded holes in nuts 15 so as to frictionally engage and bind bolts inserted in the nuts and assist the plastic plugs 8 in preventing loosening of such bolts.

The underside of each pad 35 is provided with a tacky bonding surface covered by a paper sheet 38 which may be peeled off. In order to strengthen the adhesion of pad 35 to the tie the depression 11 is coated with rubber cement and the pad is applied at the place of manufacture of the tie while the tie is still warm from the steam curing process which is customarily used with concrete ties. This insures that the pad is in proper contact with the tie and when shipping to the job site no foreign matter can enter between the adhered surfaces.

Each pad 35 is slightly narrower than tie 11 so that the pads will not be pulled loose in the handling of the ties. This further prevents foreign material from entering under the pad and interfering with the seating of the parts to be described which are clamped on top of the pad. Each pad 35 is of sufficient length to cause its opposite end portions 39 to bend upward and cover at least the lower portions of the opposite side walls 12 of depression 11. The top surface of each pad 35 contains grooves 40 under the rail and parallel to the direction of the rail to allow lateral displacement of the neoprene and provide a resilient seat for the rail.

Thus the pad 35 seats the rail flange 44 and a pair of hold-down clips 45 wherein each clip is secured by a bolt 46 in a nut 15 as shown in FIG. 5 on the left side of rail R. The threads on bolt 46 are gripped by plastic plugs 18 and the binding edges of holes 37 in pad 35 to prevent loosening of the bolts as previously described.

One end 47 of clip 45 bears against upturned pad end portion 39 on side wall 12 of the depression 11 to prevent outward movement of the clip and reduce the shear stress on bolt 46. A horizontal flange 48 on the other end of the clip overlies rail flange 44 and clamps the rail flange down against pad 35. A vertical surface 50 on this end of the clip provides an abutment confronting the edge of the rail flange to hold the rail in position and prevent lateral movement.

Since rail flanges are not all of equal width, provision is made to accommodate this variation in dimension. Vertical abutment surface 50 is positioned to engage the edge of the widest rail flange in use on railway track rails. When the rail flange is of lesser width a shim 51 is inserted between the edge of the rail flange and abutment surface 50. Shim 51 has a right angle head 52 on one end as shown in FIG. 7. The opposite end 53 is adapted to be bent outward to lock the shim in position. The shims are often needed, for example, in replacing wood ties on old rail lines having rails with narrow flanges.

Also, rail flanges are not all of equal thickness. In order to provide positive clamping action on flanges of different thickness the under side of the clip is relieved at 54 in way of bolt 46. Thus the outer end 47 of the clip provides a fulcrum causing bolt 46 to clamp the clip flange 48 tightly against rail flange 44 regardless of variations in the thickness of the latter.

When the track rails carry an electric current for signal or other purposes it may be necessary to insulate clip 45 from the tie, depending upon the composition of the tie. For this purpose an insulating bushing 55 made of a suitable plastic such as nylon is press fitted in bolt hole 56 in clip 45. Bushing 55 has a top flange 57 underlying metal washer 58 and the head of bolt 46. When this electrical insulation is not needed the bushing 55 may be omitted.

Clip 45 is very economical to manufacture. It may be produced as a rolled shape which requires only cutting to length and the drilling or punching of hole 56. A punched hole is shown by way of example, the punching operation producing a tapered hole whereas a drilled hole would be cylindrical.

FIGS. 9–12 show a different form of clip 60 which may be used in the assembly just described. Clip 60 has an underarm 61 seated on cushion pad 35 and an upper arm 62 which clamps down on top of flange 44 on rail R. Lower arm 61 terminates in a vertical abutment surface 63 confronting the edge of rail flange 40. On the outer end of clip 60 the bend 64 between arms 61 and 62 bears against pad end portion 39 overlying the side wall 12 of depression 11.

Figure 11:
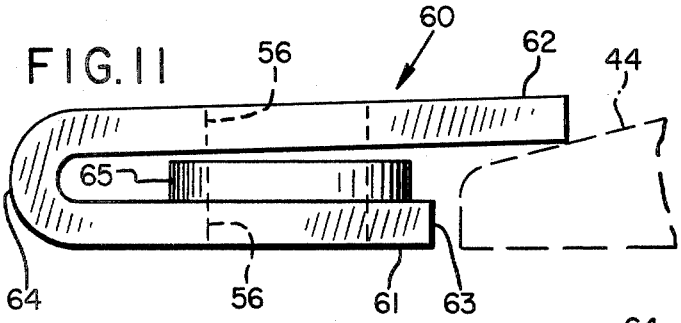
FIG. 11 is a side elevation view of the clip in FIGS. 9 and 10, showing a round spacer.

As in the case of the clip 45 shown in FIG. 5 a shim 51 will be inserted to fit rail flanges of less than the maximum width and an insulating bushing 55 will be inserted in the bolt holes 56 in the clip when electrical insulation is necessary at this point. In order to prevent undesirable distortion of clip 60 when bolt 46 is tightened in nut 15 a metal spacer washer 65 is inserted between the lower and upper arms 61 and 62 and flash welded to lower arm 61 as shown in FIG. 11.

Figure 12:
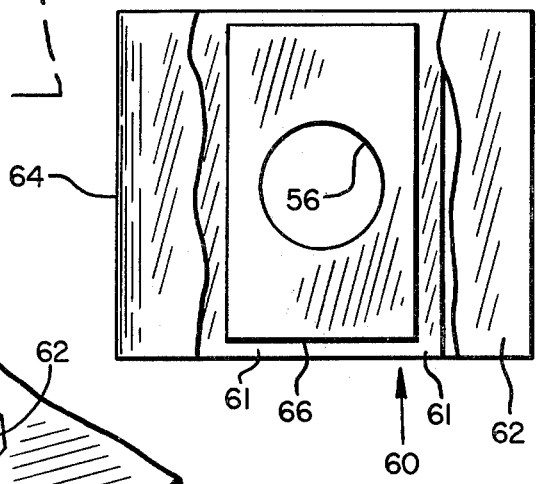
FIG. 12 is a top plan view with parts broken away showing a similar clip with a rectangular spacer.
Figure 10:
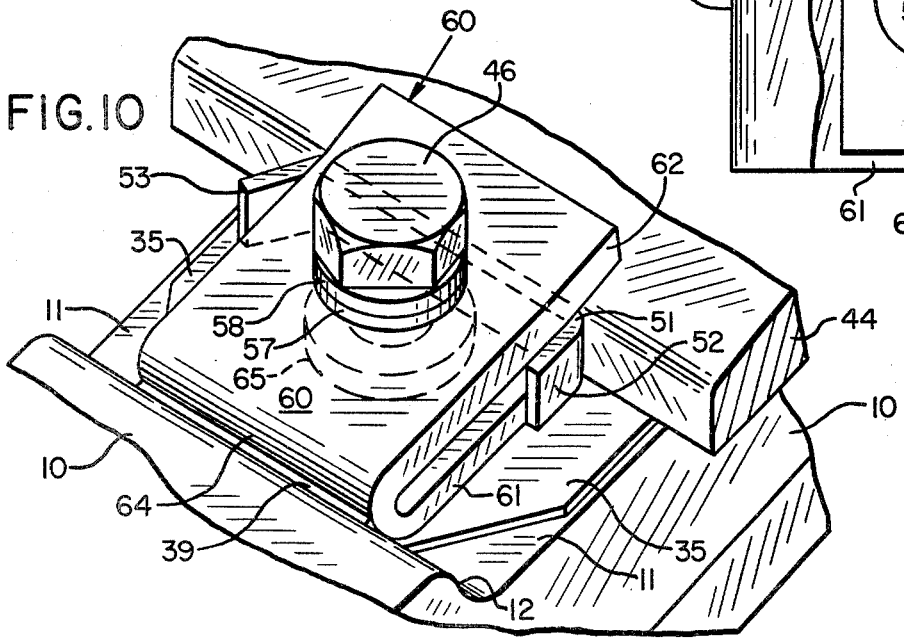
FIG. 10 is a perspective view of the clip in FIG. 9.

Alternatively, the spacer may comprise an apertured rectangular metal plate 66 welded to lower arm 61 as shown in FIG. 12.

It is understood, of course, that there are a pair of clips 45 and bolts 46 on opposite sides of the rail in FIGS. 5 and 7, corresponding to the pair of clips 60 on opposite sides of the rail in the more extensive view in FIG. 9.

What is claimed is:

1. A railway rail holding assembly comprising a molded base member having a depression in its top surface with side walls on opposite sides of the rail; a pad of cushion material adhered in said depression with the ends of the pad bent upward to cover said side walls, the molded material of said base member being heat cured and said pad being adhered to said base member while said base member is warm from heat curing, grooves in the top surface of said pad in an area of the pad in contact with the rail; a pair of elongated vertical tubular nuts embedded in said base member with their upper ends underlying said pad on opposite sides of the rail, each tubular nut having a reduced cylindrical neck portion connecting the upper end of the nut with a lower end which is thicker and wider than said neck and which is transversely flattened at its lower extremity, a corrosion preventing coating on said tubular nuts, and sand adhered to said coating to provide a bond between said tubular nuts and said molded material of said base member; an apertured clip on said pad on each side of the rail, one end of each clip bearing against said pad on said side wall of the depression and the opposite end of the clip bearing against the top of the rail flange and having a vertical abutment surface confronting an edge of the rail flange; a bolt extending through the aperture in said clip and having threaded engagement in said tubular nut; aligned radial threaded holes in opposite sides of said tubular nut containing threaded plastic plugs having inner ends frictionally engaging threads on said bolt to prevent rotation of the bolt, the outer ends of said plugs being flush with the outer surface of said tubular nut and engaging the molded material of said base member, said plastic plugs being spaced from the upper end of said nut so that they are not engaged by a threaded tool which positions the upper end of the nut in a mold for said base member when the base member is molded; and bolt holes in said pad of smaller diameter than said bolts causing said pad to grip the bolts and assist in preventing rotation of the bolts in service.

2. An assembly as defined in claim 1 including an insulating bushing disposed in the aperture of said clip and having a radial top flange overlying said clip.

3. An assembly as defined in claim 1 including a shim insertable between said vertical abutment surface on said clip and said edge of said rail flange.

4. An assembly as defined in claim 1, said clip comprising a rigid block of metal having an outer end portion with a bottom surface seated on said pad, and a top flange on said opposite end of said clip arranged to overlie said rail flange; the bottom surface of said clip being relieved in way of said bolt between said outer end portion and said vertical abutment surface causing said bolt to fulcrum said clip on said outer end portion and clamp said clip flange on said rail flange.

5. An assembly as defined in claim 1, said clip comprising a resilient U-shaped metal plate having said vertical abutment surface on an under arm which is seated on said pad, said clip having an upper arm bearing against the top of said rail flange, and a metal spacer between said arms welded to said under arm, said bolt extending through both of said arms and said spacer.

6. An assembly as defined in claim 1, said base member containing prestressing cables extending transversely of said rail, and reinforcing members in said base member adjacent said tubular nuts, each reinforcing member comprising a metal bar bent to approximately rectangular configuration and surrounding a plurality of said cables.

* * * * *